United States Patent [19]

Lucas et al.

[11] 4,035,891

[45] July 19, 1977

[54] METHOD OF FORGING AND PRESS-FORMING ALUMINUM WHEEL

[75] Inventors: Roger Lucas, Issoire; Jacques Auberger, Jumeaux, both of France

[73] Assignee: FORGEAL, societe pour le Forgeage et l'Estampage des Alliages Legers, Paris, France

[21] Appl. No.: 696,560

[22] Filed: June 16, 1976

[30] Foreign Application Priority Data

July 3, 1975 France ..... 75.21774

[51] Int. Cl.[2] ..... B21H 1/02; B21K 1/32

[52] U.S. Cl. ..... 29/159.01

[58] Field of Search ..... 29/159.01, 159.1, 159 R

[56] References Cited

U.S. PATENT DOCUMENTS

| | | | |
|---|---|---|---|
| 2,150,111 | 3/1939 | Tatter | 29/159.1 |
| 3,262,191 | 7/1966 | Albertson et al. | 29/159.01 |
| 3,270,402 | 9/1966 | Adams et al. | 29/159.01 |
| 3,364,550 | 1/1968 | Jessee et al. | 29/159.1 |
| 3,381,353 | 5/1968 | Lemmerz | 29/159.1 |
| 3,611,535 | 10/1971 | Nobach | 29/159.01 |

*Primary Examiner*—Victor A. DiPalma
*Attorney, Agent, or Firm*—Dennison, Dennison, Meserole & Pollack

[57] ABSTRACT

The invention relates to a method of making one-piece wheels for large load-carrying vehicles. Starting from a blank in the form of a cylindrical disc, the minor flange of the rim and the wheel disc are formed by hot stamping, while the major flange of the rim is obtained by press-forming from a tube section. The two parts are assembled by welding. The production cycle terminates in a few finishing operations by machining. These wheels, which may be made in particular of lightweight aluminum-based alloys, are particularly suitable for large load-carrying vehicles fitted with tubeless tires.

4 Claims, 6 Drawing Figures

METHOD OF FORGING AND PRESS-FORMING ALUMINUM WHEEL

This invention relates to a method of manufacturing, by stamping, one-piece wheels for large load-carrying vehicles intended to be fitted with tubed tires or preferably with tubeless tires.

Basically, a wheel intended to be fitted with a tire cover comprises a disc and a rim. The disc is integral with the rim and is used for attaching the wheel to the hub of the vehicle. In general, it is in the shape of a dish of which the concave surface is directed toward the hub, i.e. axially (relative to the axis of rotation) toward the interior of the vehicle so as to form a recess for accommodating the brakes. The disc is formed with several holes for the passage of bolts by which the wheel is secured to the hub, and with a hole at its center.

The rim may have a flat or hollow base. The flat base wheel is a one-piece wheel which does not utilize any removable components and which is particularly suitable for receiving tubeless tires because it is easy to make it tight to air under pressure. Each wall is extended by a conical portion (of which the cone angle is generally 15° relative to the axis of the wheel), known as the seat, intended to receive one of the beads of the tire. A short, hooked edge forms the terminal portion of each of the seats. That part of the rim directed axially toward the outside of the vehicle is generally known as the minor flange, while that part of the rim directed axially toward the interior of the vehicle is known as the major flange, the difference in size arising out of the asymmetrical position of the rim transition zone between the disc and the rim.

Wheels for heavy load-carrying vehicles are normally made of pressed and welded steel plate. This method of manufacture is particularly suitable for mass production and is relatively straightforward.

Numerous attempts have been made for producing one-piece wheels, more especially from lightweight aluminum-based alloys. Road transport rigs frequently have as many as twelve to sixteen wheels plus one or two spare wheels of which the total weight may amount to as much as 700 to 900 Kg for just the wheels alone. The use of one-piece wheels of high strength alloys and, a fortiori, lightweight alloys would provide for a significant reduction in this weight.

Numerous attempts have also been made to manufacture wheels of lightweight alloys or composite steel/-lightweight alloy wheels either by casting or by machining, stamping and/or rotary extrusion. Processes have been described in particular in U.S. Pat. Nos. 2,075,294 (Kelsey-Hayes) and 2,170,617 (Hamill), in German Patents or Patent Applications Nos. 1,297,570 (Otto Fuchs), and 1,908,465 (Otto Fuchs), in French Patent Specifications Nos. 1,186,248 (Kronprinz), 1,491,895 (Otto Fuchs) and 1,570,620 (Aluminium Francais). Unfortunately, it has not yet been possible by any of these processes to produce one-piece wheels under satisfactory technical and/or economic conditions either because these processes do not lend themselves to mass production at reasonable cost or because the wheels obtained do not have the properties required by the users, namely mechanical strength, impact resistance, corrosion resistance, in particular areas where salt is used for accelerating the melting of snow, easy maintenance (non-tarnishing, long-term maintenance of newness), easy balancing and aligning, tightness for the use of tubeless tires, dimensional precision for the safe fitting of tires of any type without any danger of blowouts.

The present invention relates to a method of making one-piece wheels for large load-carrying vehicles which is particularly suitable for mass production and which satisfies the requirements of users such as have been listed above.

The method, according to the invention, is characterized by the manufacture of the wheel in two parts followed by assembly by welding.

The wheel thus obtained requires a minimum of final finishing operations.

The first part of the wheel comprises the disc and the minor flange and is obtained by a variable number of stamping operations. In the particular case where a lightweight aluminum-based alloy is used as the starting material, there are preferably two stamping operations which will be referred to as M1 and M2.

In the first operation M1, a thickened bead is formed around the periphery of the blank in a direction substantially parallel to the axis of the wheel toward the inside of said wheel, as already defined.

In the second operation M2, the disc and the minor flange are brought into a shape very similar to the final shape.

The bead extends in the direction parallel to the axis of the wheel so as to form the beginning of the base of the rim to which the other half of the rim will be fixed by welding.

The other part of the wheel comprises the major flange of the rim. It is produced from a tubular cylindrical element obtained by extrusion or by rolling and welding.

This tube is then press-formed to obtain the major flange of the rim in a form very similar to the final form. The two halves are then assembled by welding.

The production cycle terminates in a machining operation which affects the entire external part of the rim, that which supports the tire and the inner tube, if any (hooks, edges, channel) and the inner part of the major flange, that which is directed toward the axis of the wheel.

The finishing process comprises a series of standard operations which are not specific to the process just described. These operations essentially include the forming of the central hole, the alignment of the two faces of the disc, the drilling of appropriate holes for securing the wheel to the axle of the vehicle, and drilling the valve hole and the axis opening to the valve of the twinned wheel.

In addition, known heat treatment techniques may be carried out either at intermediate stages or at the final stage in order to impart optimum properties to the metal (mechanical properties, corrosion resistance).

The invention will be more clearly understood by reference to the accompanying drawings in which.

Figure 1:
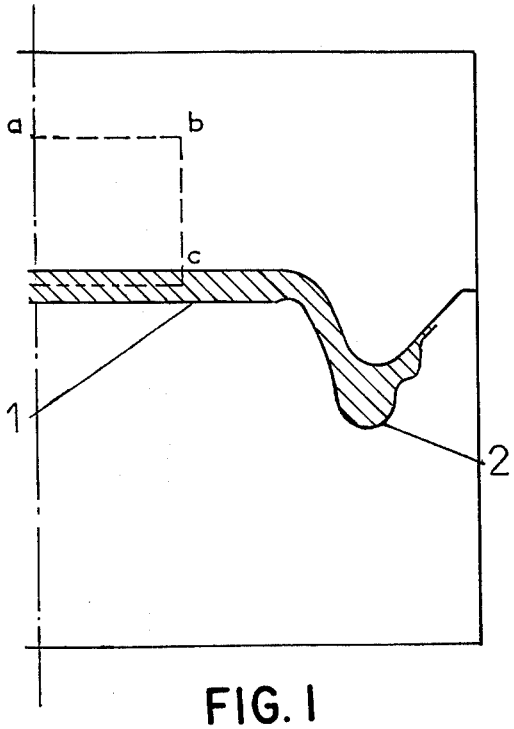
FIG. 1 is a fragmentary cross-section of a rim component with the initial bead formed thereon.

In FIG. 1, the dotted line abc represents the blank in the form of a cylindrical disc. The stamping operation M1 forms the wheel disc 1 and around its periphery, a bead 2 directed toward the interior of the wheel.

Stamping is carried out at a temperature of the order of 475° C which is suitable for aluminum alloys of the aluminum-silicon-magnesium family, such as the alloy 6061 of which the mean composition is as follows: aluminum base —silicon: 0.60%, magnesium: 1%, copper: 0.30%; chromium: 0.25%, iron < 0.50%, zinc < 0.25%, nickel < 0.05%. The stamping press is heated to approximately 400°C.

Figure 2:
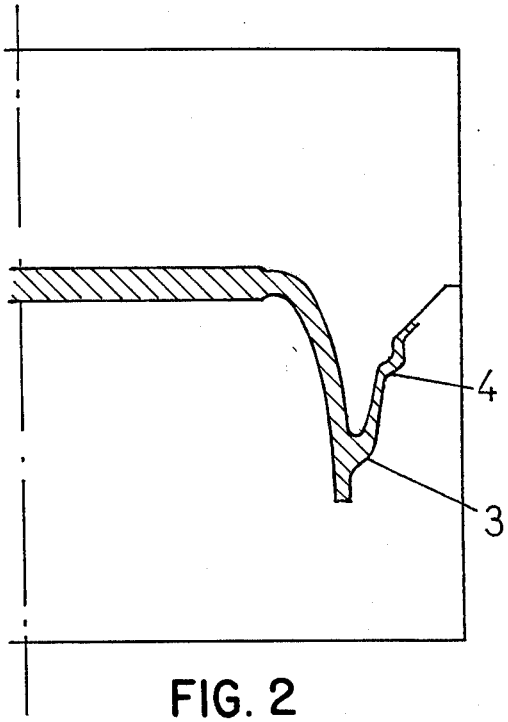
FIG. 2 is a fragmentary cross-section of a rim component illustrating the preliminary form of the minor flange.

It can be seen from FIG. 2 that the stamping operation M2 has extended the bead 2 which has assumed the shape 3, while at the same time forming the preliminary blank 4 of the minor flange of the rim.

Figure 3:
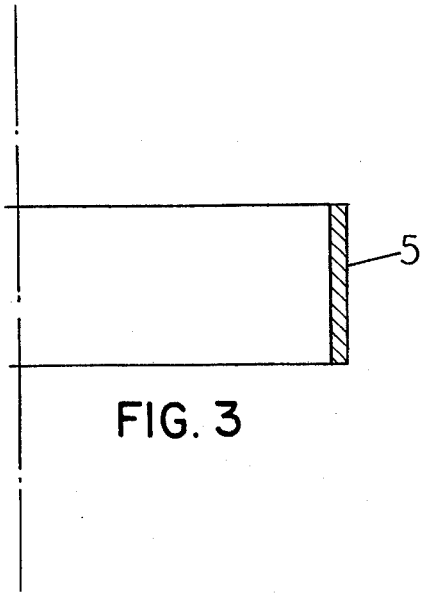
FIG. 3 is a fragmentary cross-section of the major flange component.

FIG. 3 illustrates a portion of the cylindrical tube 5 which constitutes the blank component for the major flange of the rim.

Figure 4:
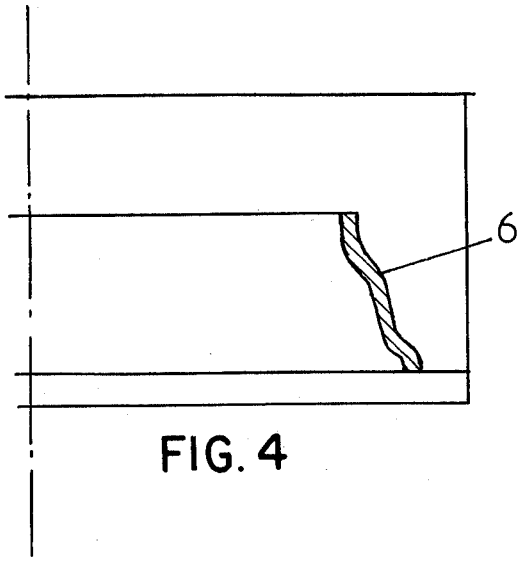
FIG. 4 is a fragmentary cross-section of the major flange component after the first forming step, but before assembly.

FIG. 4 shows the shape 6 obtained by press forming the cylindrical tube 5 to the definitive shape of the major flange.

Figure 5:
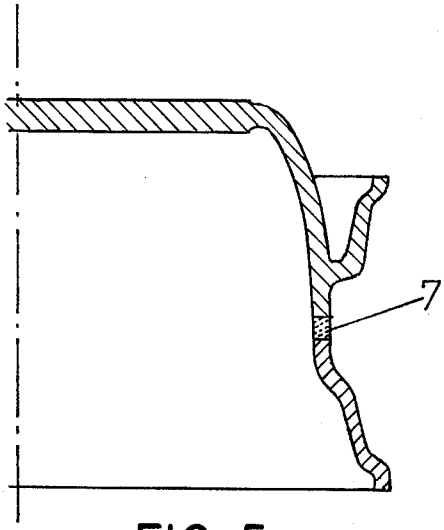
FIG. 5 is a fragmentary cross-section of the wheel with the two major components assembled by welding.

FIG. 5 illustrates the configuration of the wheel obtained by welding at 7 the two parts of the wheel corresponding to FIGS. 2 and 4.

Figure 6:
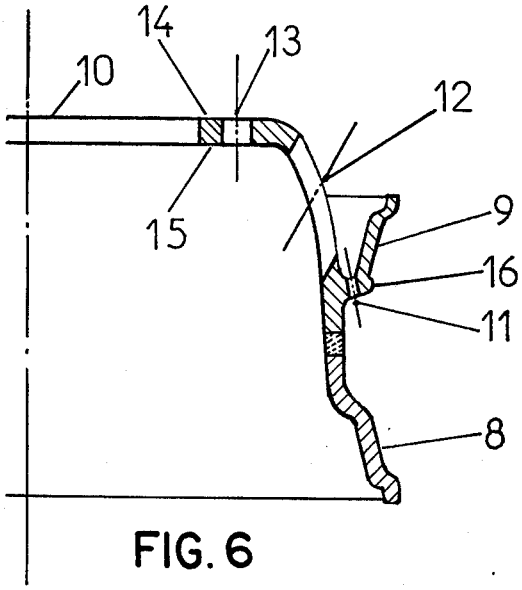
FIG. 6 is a fragmentary cross-section of the wheel and delineates the points where finishing operations will be performed.

FIG. 6 shows the final machining of the major flange 8 and minor flange 9 and the various finishing operations are carried out.

Generally, these operations include forming the central hole 10, drilling the valve hole 11, drilling the axis opening 10 to the valve of a twinned wheel, drilling the holes for the bolts 13 by which the wheel is fixed to the axle of the vehicle, aligning the two faces of the disc 14, 15, where desired, the hump 16 may also be formed during this machining operation. The object of the hump is to avoid sudden blowouts when the vehicle is traveling on underinflated tire or deflated tire as a result of a puncture or under unfavorable road conditions.

EXAMPLE

A flat disc of A-SG/6061 alloy (of which the composition is as follows: aluminum base —Silicon: 0.60%, Mg: 1.0%, Fe < 0.50%, Zn < 0.25%, Cu = 0.30%, Cr: 0.25%, Ni < 0.05%) 300 mm in diameter and 160 mm thick, was processed by the sequence of operations corresponding to the first variant, i.e., performing the stamping step M1 in a press having the capacity of approximately 20,000 tones and shaping in accordance with FIG. 1 at a temperature of approximately 475°C; performing the stamping step M2 under the same conditions in accordance with FIG. 2; press forming to the configuration in FIG. 4, the component 5 comprising the major flange; and welding of the two components together in accordance with FIG. 5.

The final machining operation was then carried out in accordance with FIG. 6. The wheel thus obtained with dimensions of 22.5 – 7.5 (expressed in inches of 25.4 mm, as is standard practice for this type of equipment, i.e., 57 – 19 cm) was designed for tires of the standard size 11 – 225. Its weight was 23 Kg, i.e. substantially half the weight of a steel wheel of the conventional type (pressed and welded).

The reduction in total weight in the case of a road transport rig equipped with wheels of this type may thus amount to as much as 300 to 400 Kg. The high thermal conductivity of aluminum and its alloys considerably facilitates the removal and dissipation of the heat emanating from the braking system which avoids local overheating and its adverse effects upon the service life of tires and inner tubes. In addition, the reduction in the weight of the wheels improves the ride of the vehicle to a certain extent by virtue of the reduction in non-suspended weight and makes braking more effective through the reduction in kinetic energy of the rotating masses which is dissipated in the form of heat during braking.

Naturally, the invention is not limited to the alloy 6061 taken as an example. Any of the metal alloys capable of being shaped by stamping and of being welded and having adequate mechanical properties for forming the wheels of large load-carrying vehicles, fall within the scope of the invention as defined by the appended claims.

We claim:

1. The method of making aluminum alloy wheels for vehicles comprising a preparation stage and a finishing stage, said preparation stage including forming the wheel disc component and the integral minor flange of the rim of said wheel by forging from a first component blank substantially in the form of a cylindrical disc, forming the major flange component of the rim by press-forming from a second component in the form of a generally tubular cylindrical element, assembling the components by welding the wheel disc component carrying the minor flange of the rim to the tubular major flange component of the rim, said finishing stage further including the steps of forming a central opening in said disc portion, forming a valve stem opening in the minor flange portion, forming a plurality of lug bolt openings in said disc portion radially outwardly of said central opening and aligning by machining the two opposite faces of the disc portion of said wheel.

2. A method of making metal wheels as claimed in claim 1 wherein the forging operation is carried out in two stages, the first comprising forming the wheel disc from a blank and shaping a bead around its circumference directed toward the inside of the wheel, and a second stamping stage extending the bead in the same direction as in said first stage and roughing out the shape of the minor flange of the rim.

3. A method of making one-piece metal wheels as claimed in claim 1 wherein a hump is formed on the minor flange during a final finishing stage.

4. The method of making aluminum wheels for vehicles comprising the following steps: forming the wheel disc component and the minor flange of the rim by forging from a blank substantially in the form of a cylindrical disc, forming the major flange component of the rim by press-forming from a tubular cylindrical element, assembling by welding the wheel disc component and the minor flange of the rim on the one hand and the major flange component of the rim on the other hand.

* * * * *